US006363529B1

(12) United States Patent
Bocook, Jr.

(10) Patent No.: US 6,363,529 B1
(45) Date of Patent: Apr. 2, 2002

(54) FINGER GLOVE FOR MUZZLE-LOADING

(76) Inventor: David A. Bocook, Jr., 424 E. Wolfe St., Harrisonburg, VA (US) 22802

( * ) Notice: Subject to any disclaimer, the term of this patent is extended or adjusted under 35 U.S.C. 154(b) by 0 days.

(21) Appl. No.: 09/730,392

(22) Filed: Dec. 6, 2000

(51) Int. Cl.[7] ..... A41D 13/00
(52) U.S. Cl. ..... 2/21; 42/90; 294/25
(58) Field of Search ..... 2/159, 160, 161.1, 2/17, 163, 16, 20, 21; 42/90, 104; 294/25

(56) References Cited

U.S. PATENT DOCUMENTS

| | | | | | |
|---|---|---|---|---|---|
| 1,479,771 | A | | 1/1924 | Campbell | |
| 2,270,882 | A | | 1/1942 | Link | |
| 2,852,779 | A | | 9/1958 | Roessler | |
| 3,344,436 | A | | 10/1967 | Stubbs | |
| 3,736,926 | A | | 6/1973 | Irby | |
| 4,383,336 | A | | 5/1983 | Beckman et al. | |
| 4,447,912 | A | | 5/1984 | Morrow | |
| 4,670,909 | A | | 6/1987 | Forrester | |
| 5,004,231 | A | * | 4/1991 | Alread | 272/143 |
| 5,088,121 | A | * | 2/1992 | Wallace | 2/160 |
| 5,097,615 | A | | 3/1992 | Kearns | |
| 5,276,922 | A | * | 1/1994 | Floyd, Jr. | 2/160 |
| 5,699,632 | A | * | 12/1997 | Stout et al. | 43/25 |
| 5,864,884 | A | * | 2/1999 | Salvitti | 2/159 |
| 5,971,240 | A | * | 10/1999 | Dequaine | 224/217 |
| 6,195,927 | B1 | * | 3/2001 | Fortenberry | 42/90 |

* cited by examiner

*Primary Examiner*—John J. Calvert
*Assistant Examiner*—Katherine Moran
(74) *Attorney, Agent, or Firm*—Richard C. Litman

(57) ABSTRACT

The present invention is directed to a finger glove utilized to grasp a ramrod when tamping down a black powder charge and bullet in a long rifle or handgun. The glove is constructed of nylon-strap material with a vertical pocket for engaging the end of the ramrod on one side of the strap and loops for engaging a plurality of fingers, preferably the little finger through the middle finger, on the other side of the strap. This device reduces the amount of arm strength required to load the long rifle or handgun and since the end of the ramrod bears against the bottom of the pocket, distributes the force laterally to the fingers engaging the strap.

7 Claims, 2 Drawing Sheets

FINGER GLOVE FOR MUZZLE-LOADING

BACKGROUND OF THE INVENTION

1. Field of the Invention

The present invention relates generally to an accessory for a muzzle-loading gun. More specifically, the invention is a finger glove for use in muzzle-loading a black powder rifle with a ramrod.

2. Description of the Related Art

The process of loading a muzzle-loading rifle, such as a black powder rifle, is often hard on the hands. Since it is difficult to grasp the ramrod by curling the fingers around the rod and then push the ramrod into the barrel with enough pressure to seat the charge without sliding up and down the rod, the shooter often resorts to pressing down on the end of the ramrod with the palm of his hand. This procedure is hard on the palm of the hand, and can also be dangerous, as the rifle has a tendency to lean towards the shooter's head or body as he tries to develop enough leverage to drive the ramrod through the muzzle. The related art of interest describes various devices to ease the process of loading a muzzle-loading rifle, and various gloves used for improving grip on rod-shaped devices, but none discloses the present invention. The related art will be discussed in the order of perceived relevance to the present invention.

U.S. Pat. No. 1,479,771 issued on Jan. 1, 1924, to Guy E. S. Campbell describes a golfer's palm shield comprising a single piece made of India rubber to cover the upper palm region and a portion of the index finger and having apertures in the palm region for vacuum enhancement. The palm shield is distinguishable for its elastic composition and covering of the palm with vacuum inducing apertures.

U.S. Pat. No. 5,088,121 issued on Feb. 18, 1992, to Jacqueline E. Wallace describes a glove or mitten with a pocket in the palm region for holding a chemical repellant device. The glove or mitten is distinguishable for its hand coverage and pocket aligned and open in the direction of the thumb.

U.S. Pat. No. 4,447,912 issued on May 15, 1984, to Rosemary K. Morrow describes a prosthetic device to enable disabled persons to hold toothbrushes, pencils or toys by an elongated patch. The partial glove covers the palm region and the back of the palm and uses hook and loop fastening for the straps at the wrist and in the palm. The device is distinguishable for its two straps and the elongated patch on the palm.

U.S. Pat. No. 2,270,882 issued on Jan. 27, 1942, to Albert C. Link describes a gripping glove for a golf club comprising a glove having the fingertips open, a flap opened up in the palm for wrapping partially around the club handle, and a wrist strap. The golfing glove is distinguishable for its opened up palm region with a flap.

U.S. Pat. No. 5,097,615 issued on Mar. 24, 1992, to Robert M. Kearns describes a muzzle loading device for muzzle loading firearms comprising a tubular transparent cartridge for holding the powder charge and bullet and a plunger. The device illustrates a mechanical means for loading a muzzle.

U.S. Pat. No. 4,670,909 issued on Jun. 9, 1987, to Lynne Forrester describes a pocket glove comprising a zippered pocket formed on the back of the hand for holding a keychain and keys. The glove is distinguishable for requiring a complete glove and a zippered pocket.

U.S. Pat. No. 3,736,926 issued on Jun. 5, 1973, to Hanes E. Irby describes an infant's hand cover lacking fingertips and including a palm covering resilient body. The glove is distinguishable for its padded palm.

U.S. Pat. No. 3,344,436 issued on Oct. 3, 1967, to Frank F. Stubbs describes a palm padded bowling glove comprising a middle finger strap and a wrist strap. The bowling glove is distinguishable for its limited palm and finger covering.

U.S. Pat. No. 2,852,779 issued on Sep. 23, 1958, to Ellamae W. Roessler describes a golf club holding glove having an elastic band wrappable around the full sized glove and golf club handle. The glove is distinguishable for its wraparound strap and full glove.

None of the above inventions and patents, taken either singularly or in combination, is seen to describe the instant invention as claimed. Thus, a finger glove for muzzle-loading solving the aforementioned problems is desired.

SUMMARY OF THE INVENTION

The present invention is directed to a finger glove utilized to grasp a ramrod when tamping down a black powder charge and bullet in a long rifle or handgun. The glove is constructed of nylon-strap material with a vertical pocket for engaging the end of the ramrod on one side of the strap and loops for engaging a plurality of fingers, preferably the little finger through the middle finger, on the other side of the strap. This device reduces the amount of arm strength required to load the long rifle or handgun and since the end of the ramrod bears against the bottom of the pocket, distributes the force laterally to the fingers engaging the strap.

Accordingly, it is a principal object of the invention to provide a finger glove for tamping down a black powder charge and bullet in a long rifle or handgun.

It is another object of the invention to provide a finger glove having a vertical pocket for engaging the end of a ramrod.

It is a further object of the invention to provide a finger glove with separate loops for engaging one's fingers.

Still another object of the invention is to provide a finger glove which reduces the force required to load a black powder rifle or handgun and eliminates the use of one's palm when tamping.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

DETAILED DESCRIPTION OF THE PREFERRED EMBODIMENT

Figure 1:
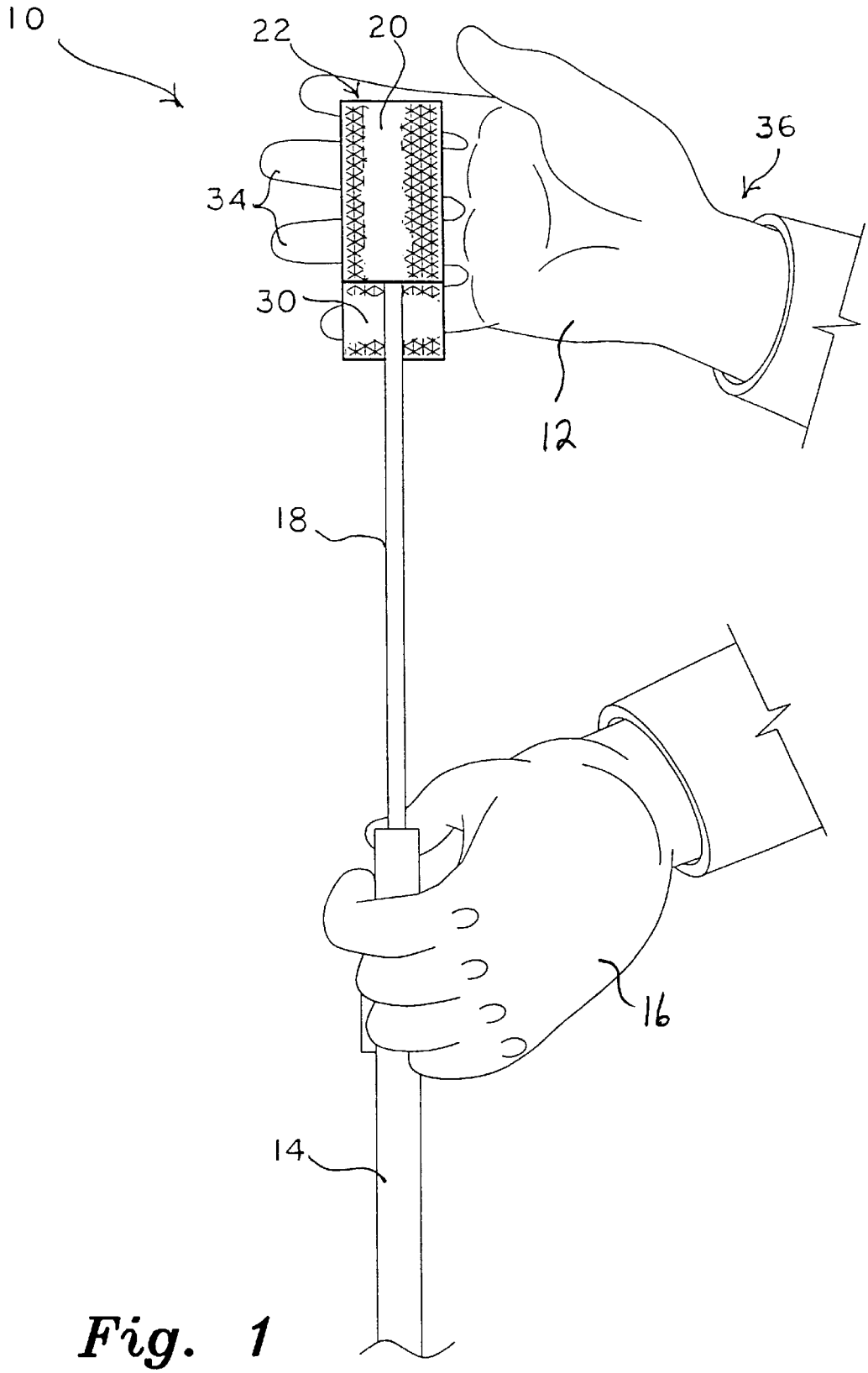
FIG. 1 is an environmental, front view of a finger glove for muzzle-loading a black powder long rifle according to the is present invention.
Figure 2:
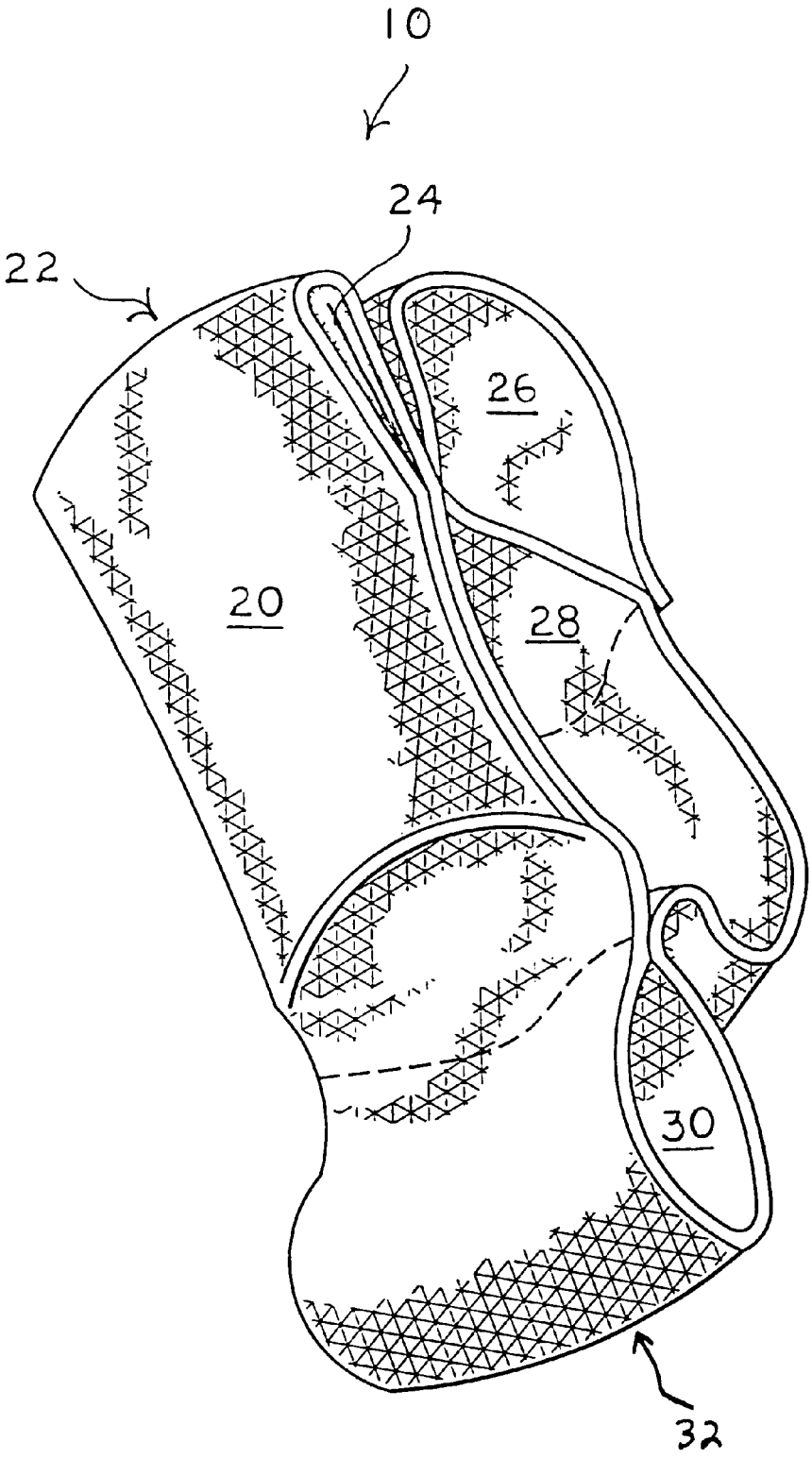
FIG. 2 is a perspective view of the finger glove similar reference characters denote corresponding features consistently throughout the attached drawings.

The present invention illustrated in FIGS. 1 and 2 is directed to a finger glove 10 held in one hand 12 for tamping down a black powder charge and bullet into a long rifle or handgun 14 with a ramrod 18, the rifle 14 being held with the other, preferably gloved, hand 16. In a preferred embodiment, three of the fingers can be inserted into the glove 10 with the index finger and thumb free, or four of the fingers can be inserted into the glove 10. The free index finger can be placed over the end of the pocket and the thumb placed over the glove on the side opposite the fingers to more securely press down on the ramrod 18. The glove 10 can be made with different finger loop configurations, such as with only two loops, or with four loops. The finger glove 10 can be used over, or incorporated into, a full hand glove.

The finger glove 10 is made preferably from a black nylon strap or strip of webbing material approximately 1.5 inches wide and 17.5 inches long. However, the colors can be varied, including a camouflage color. A pocket 20 is formed on one side of the strap at a first front end 22 and reinforced with another layer 24 of webbing for resisting abrasion from the end of the ramrod 18. Three adjacent loops in the preferred embodiment are formed on the opposite side of the strap, with the first loop 26 and the second loop 28 formed at the rear of the pocket 20. The third loop 30 is formed at a second front end 32 for accepting the fingers 34 of a person 36.

The second loop 28 of the glove 10 is stitched to below open mouth of the pocket 20. The first loop 26 is formed doubling back the end of the strap and stitching it to the outs of the second loop 28. The first loop 26 of the glove 10 stitched to the rear of the pocket 20. The finger loops can cushioned on the inside with wool, polar fleece or the like soft material. The glove 10 can be worn by right- or left-handed users and weighs less than an ounce.

The ramrod 18 can now be jammed into a hot muzzle of a long barreled rifle or handgun 14 without injury to the fingers 34 of the user person 36 by inserting the end of the ramrod into the pocket 20 and pushing the ramrod 18 into the muzzle, the ramrod bearing against the bottom of the pocket, the pushing force being distributed among the three fingers, preferably the little finger, ring finger, and middle finger, inserted through the loops 26, 28 and 30. The index finger may be placed over the end of the pocket to guide the ramrod 18, and the thumb may be placed over the pocket 20 on the side opposite the fingers to grasp the ramrod 18 more firmly.

A pocket for containing a black powder load or any small accessory can be included on the back of the finger glove 10. A thimble can be attached inside the pouch 20 as reinforcement to abut the end of the ramrod 18.

Thus, a finger glove for safely manipulating a hot ramrod in the loading of muzzle-loading rifles or revolvers in any position, e.g. seated, kneeling or standing, has been shown. A safety feature is that one's face need no longer be above the muzzle. The fingers and thumb are protected from touching the ram rod while loading. A decided advantage is that the open palm need no longer be used to tamp down on the end of the tamping rod. The glove is waterproof and can be worn comfortably on the hand at all times during the shooting period. It has been found that previous cleaning of the gun after each shooting was necessary to correctly seat the bullet inside the barrel correctly. Now, with this finger glove, another bullet can be shot without cleaning the gun.

It is to be understood that the present invention is not limited to the embodiment described above, but encompasses any and all embodiments within the scope of the following claims.

I claim:

1. A finger glove for muzzle-loading with a tamping rod comprising:

a fabric strap having a pocket at a first front end for accepting a ramrod; and a first, a second, and a third loop connected in series with the first loop and the second loop formed at the rear of the pocket, and the third loop formed at a second front end for accepting fingers of a user;

whereby an end of a ramrod can be inserted into the pocket and the ramrod may be forced into a muzzle of a long barreled rifle, the ramrod bearing against the pocket and the force being distributed among the finger's inserted through the at least one loop.

2. The finger glove according to claim 1, wherein the pocket of the fabric strap is reinforced with a second layer.

3. The finger glove according to claim 1, wherein each said loop is lined with a cushion material selected from the group consisting of wool and fleece.

4. The finger glove according to claim 1, wherein the finger glove is made of nylon fabric webbing material.

5. The finger glove according to claim 1, wherein the first loop of the fabric strap is stitched to the rear of the pocket.

6. The finger glove according to claim 1, wherein the second loop of the fabric strap is stitched to below an open mouth of the pocket.

7. The finger glove according to claim 1, wherein the first loop of the fabric strip is formed by stitching an end of the strap to the second loop.

* * * * *